US005217150A

United States Patent [19]

Chen

[11] Patent Number: 5,217,150

[45] Date of Patent: Jun. 8, 1993

[54] BELT BUCKLE WITH A CUTTING TOOL INCORPORATED THEREIN

[75] Inventor: Paul Chen, Taipei, Taiwan

[73] Assignee: Galu Trading Co., Ltd., Taipei, Taiwan

[21] Appl. No.: 740,562

[22] Filed: Aug. 5, 1991

[51] Int. Cl.[5] ..... A44B 11/00

[52] U.S. Cl. ..... 224/163; 224/232; 30/151; 30/162

[58] Field of Search ..... 224/163, 232; 30/162, 30/151, 335

[56] References Cited

U.S. PATENT DOCUMENTS

| | | | |
|---|---|---|---|
| 4,096,979 | 6/1978 | Collins | 224/163 |
| 4,265,017 | 5/1981 | Collins | 30/162 |
| 4,389,775 | 6/1983 | Collins | 224/163 |
| 4,466,561 | 8/1984 | Slaughter | 224/163 |
| 4,481,712 | 11/1984 | Phelps | 224/163 |
| 4,529,111 | 7/1985 | Hayakawa | 224/163 |
| 4,753,377 | 6/1988 | Poluhowich | 224/232 |
| 4,926,555 | 5/1990 | Lemaire | 30/162 |

*Primary Examiner*—Linda J. Sholl

*Attorney, Agent, or Firm*—Lowe, Price, LeBlanc & Becker

[57] ABSTRACT

A belt buckle having a sliding groove on the top edge thereof for mounting a small cutting tool and a stub rod upstanding from said sliding groove at the middle adjacent to the front entrance thereof to guide said cutting tool into said sliding groove and simultaneously to disconnect the blade of said cutting tool from the handle thereof permitting said handle to be moved into said sliding groove so as to receive said blade, and a locating means to retain said cutting tool in place.

3 Claims, 4 Drawing Sheets

BELT BUCKLE WITH A CUTTING TOOL INCORPORATED THEREIN

BACKGROUND OF THE INVENTION

The present invention relates to a belt buckle and relates more particularly to such a belt buckle having a small cutting tool incorporated therein.

A belt buckle is specifically designed for fastening a belt around the waist. It may be simultaneously used as an ornament, however, it does not provide any additional function. Further, in our daily life, we may frequently need a cutting tool for cutting things. However, it is not convenient to constantly carry a cutting tool with oneself.

SUMMARY OF THE INVENTION

The present invention has been accomplished under the circumstances in view. It is therefore the main object of the present invention to provide a belt buckle which has a small cutting tool incorporated therein. It is another object of the present invention to provide a belt buckle having a small cutting tool incorporated therein in which the cutting tool can be conveniently removed from the buckle and then pushed back into position.

According to the present invention, a belt buckle has a sliding groove on the top edge thereof for mounting a cutting tool, a locating means to retain said cutting tool in place, and a stub rod for guiding said cutting tool into said sliding groove. The cutting tool is comprised of a blade which has a hole at one end, and a handle which is comprised of a small casing covered with a cover plate. The casing has a strip spring fastened therein which strip spring has a raised portion engaged in the hole on the blade to secure the blade in place. The cover plate of the handle has an elongated slot longitudinally disposed at the middle and terminated in an expanded hole into which the stub rod on the body is inserted to disconnect the blade from the strip spring permitting the handle to be moved into the sliding groove so as to receive the blade therein.

DETAILED DESCRIPTION OF THE PREFERRED EMBODIMENT

Figure 1:
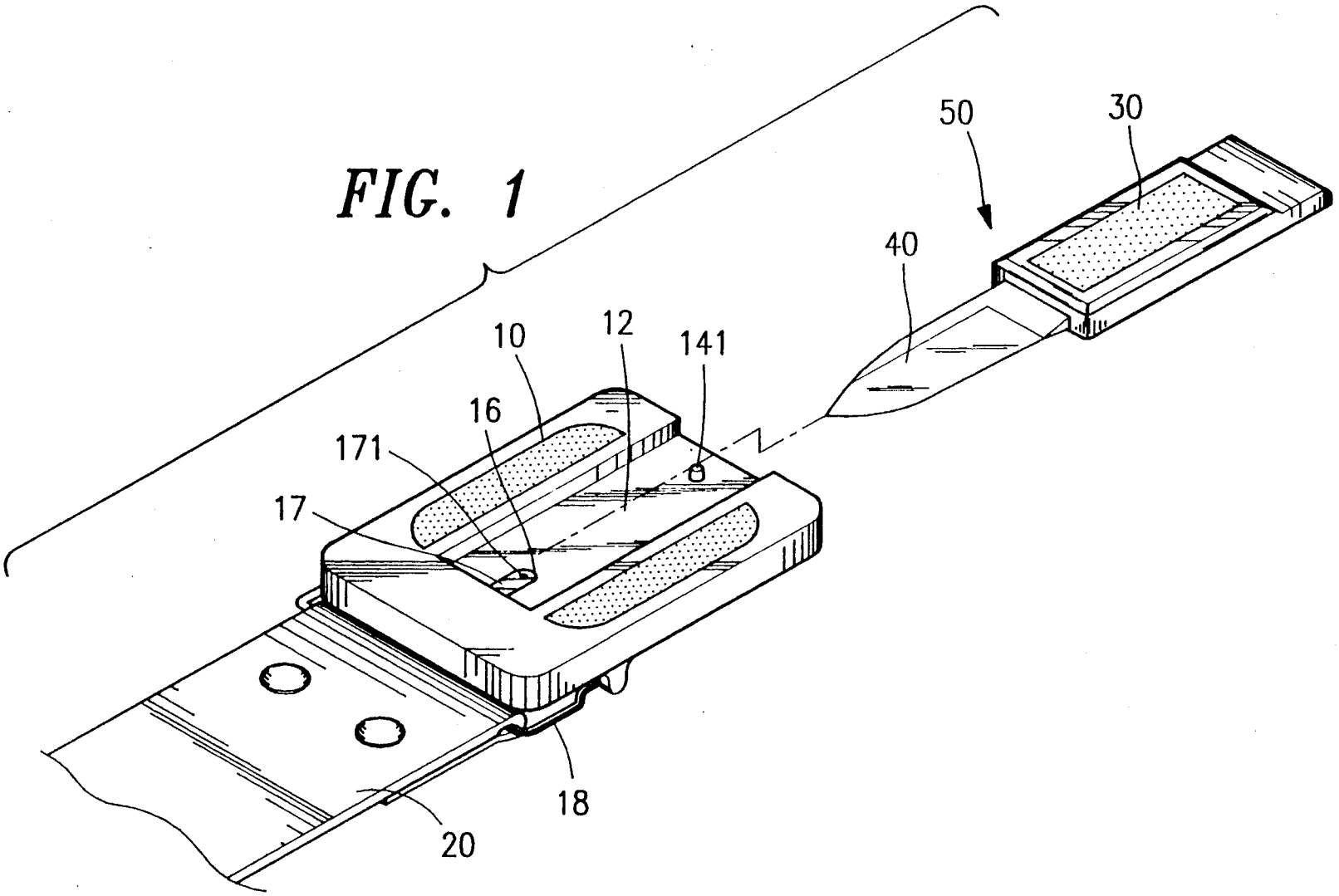
FIG. 1 is a dismantled elevational view of the preferred embodiment of the belt buckle of the present invention.

Referring to FIG. 1, therein illustrated is the preferred embodiment of the belt buckle of the present invention which is generally comprised of a body 10 made in any of a variety of geometric figures and having a sliding groove 12 longitudinally disposed on the top edge thereof for mounting a small cutting tool 50, a stub rod 14 vertically inserted therethrough at the middle adjacent to the front entrance 143 of said sliding groove 12, which is comprised of a top end 141 and a bottom end 142 respectively projecting over the top and bottom edges thereof (see FIG. 3), a through-hole 16 through said sliding groove 12 at the rear end thereof (opposite to said front entrance 143), a plate spring 17 transversely disposed above said through-hole 16 which has a raised portion 171 on the top adjacent to the front free end thereof, and a loop 18 hinged thereto at the bottom for connecting a belt 20.

Figure 2:
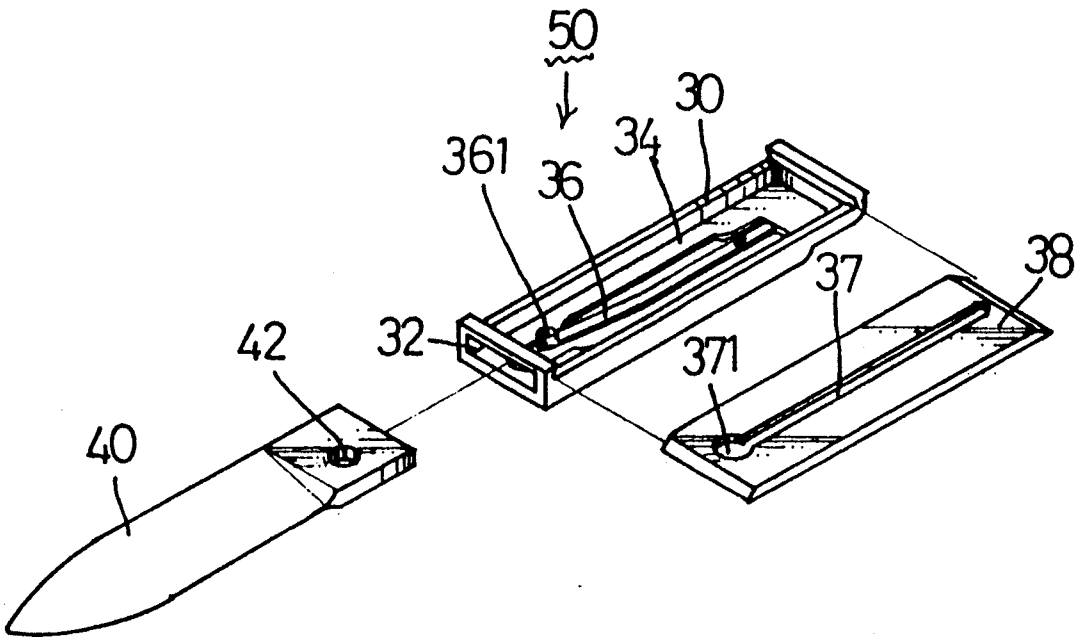
FIG. 2 is an exploded perspective view of the small cutting tool thereof.

Referring to FIG. 2, a cutting tool 50 in accordance with the present invention is generally comprised of a blade 40 and a handle 30. The blade 40 can be received inside the handle 30 so that the handle 30 can be fastened in the sliding groove 12 on the body 10 of the belt buckle, or drawn out of said handle 30 for cutting operation. The handle 30 of the cutting tool 50 is made from a box-like structure defining a chamber 34 for receiving the blade 40 and covered with a cover plate 38 which has an elongated slot 37 longitudinally disposed at the middle, which elongated slot 37 is terminated in an expanded hole 371 at one end. As illustrated in the drawing, the handle 30 comprises an opening 32 at one end through which the blade 40 can be inserted in the chamber 34. There is also provided an elongated strip spring 36 inside the handle 30, which strip spring 36 has one end secured in the inner surface of the handle 30 and a a raised portion 361 on the opposite, free end thereof. The blade 40 has a hole 42 at one end into which the raised portion 361 on the strip spring 36 is engaged to retain the blade 40 to the handle 30. By mounting the expanded hole 371 at one end of the elongated slot 37 on the top end 141 of the stub rod 14, the handle 30 can be moved in the sliding groove 12. By means of the bottom end 142 of the stub rod 14, the opposite end of the belt 20 can be fastened in place.

Figure 3:
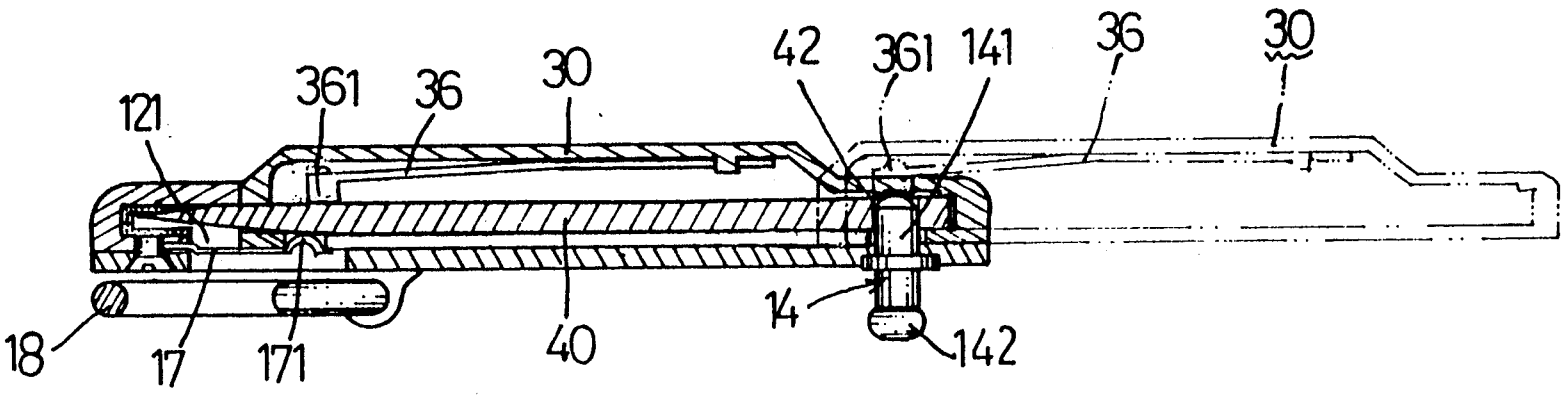
FIG. 3 is a sectional elevational view thereof.

Referring to FIG. 3, insert the blade 40 in a notch 121 on the body 10 at the back of the sliding groove 12 and above the plate spring 17 permitting the expanded hole 371 of the elongated slot 37 to engage with the top end 141 of the stub rod 14, and then, press the handle 30 downwards permitting the top end 141 of the stub rod 14 to insert in the hole 42 on the blade 40, and therefore, the raised portion 361 of the strip spring 36 is disengaged from the the hole 42 on the blade 40 (as shown in the dotted line in FIG. 3). Then, push the handle 30 toward the blade 40 into the sliding groove 12. By means of the guide of the top end 141 of the stub rod 14 in the elongated slot 37, the handle 30 is conveniently moved into the sliding groove 12 permitting the blade 40 to be received in the chamber 34 (see the real line in FIG. 3). When the handle 30 is moved into the sliding groove 12, a pressure from the blade 40 is applied at the raised portion 171 of the plate spring 17 causing it to displace downwards. Because of the elastic resilient property of the plate spring 17, an upward pressure from the raised portion 171 of the plate spring 17 firmly squeezes the blade 40 in place. At the same time, the raised portion 361 on the strip spring 36 is forced to tightly press against the blade 40. Therefore, the cutting tool 50 is firmly retained in the body 10 of the buckle.

Removing the cutting tool 50 from the body 10 of the buckle is quite easy. Drawing the handle 30 out of the sliding groove 12 causes the top end 141 of the stub rod 14 to be stopped at the expanded hole 371 of the elongated slot 37. Once the top end 141 of the stub rod 14 is stopped at the expanded hole 371, the elastic resilient property of the strip spring 36 immediately forces the raised portion 361 thereof to engage into the hole 42 on the blade 40, causing the top end 141 of the stub rod 14 to disconnect from the cutting tool 50, and therefore, the cutting tool 50 is separated from the body 10 of the buckle.

Figure 4:
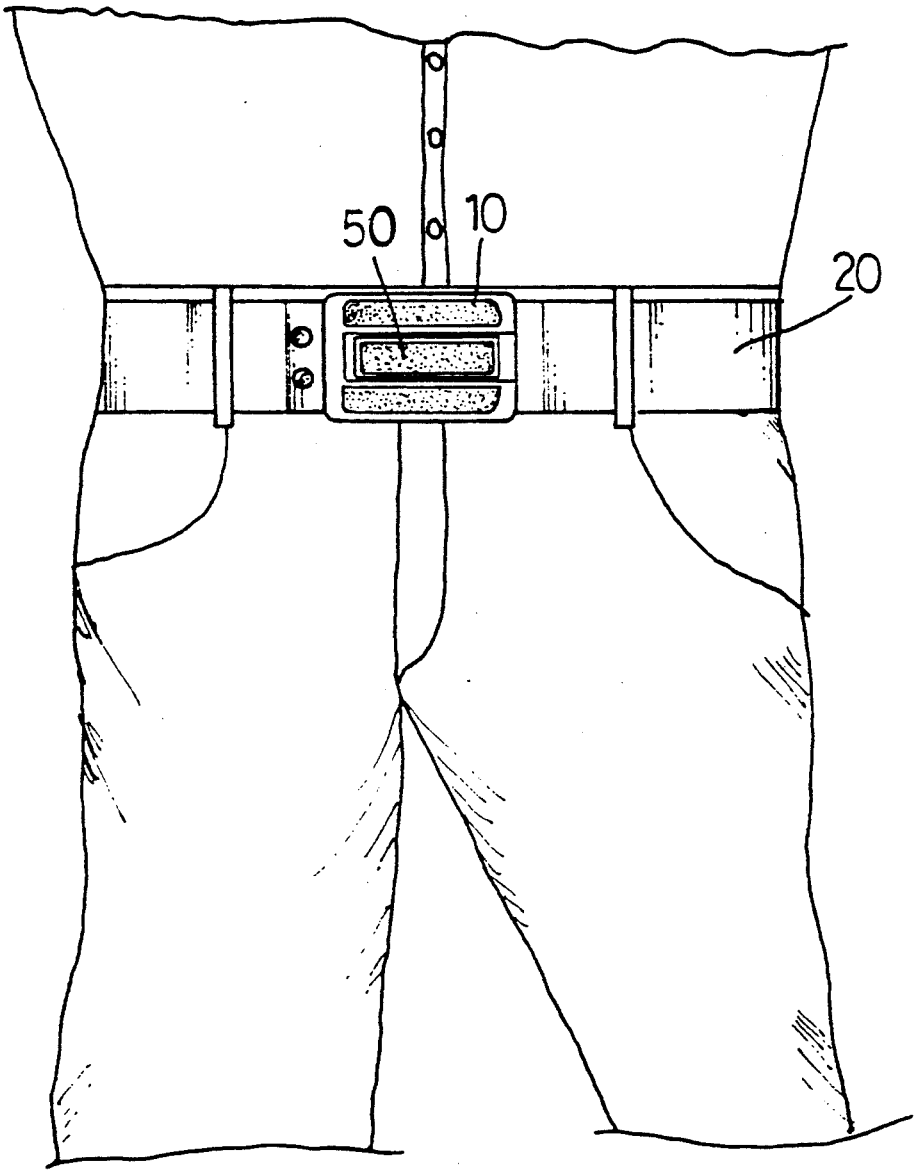
FIG. 4 illustrates that the belt into which the present invention is incorporated is fastened around the waist.

Referring to FIG. 4, the belt 20 is fastened around the waist by the buckle of the present invention in which the cutting tool 30 forms a part of the buckle. Therefore, viewing from the outside, no cutting means if shown on the buckle.

While the invention has been described in conjunction with the preferred embodiment, it is evident that many alternatives, modifications, and variations will become apparent to those skilled in the art in light of the foregoing description. For example, the sliding groove 12 on the top edge of the body 10 may be made in transverse or diagonal direction. Accordingly, it is intended to embrace all such alternatives, modifications, and variations as fall within the spirit and broad scope of the claim set forth hereinafter.

What is claimed is:

1. A belt buckle and cutting tool combination comprising a body having an inner surface, an outer surface, and having a pivotally mounted loop and a fastening rod mutually spaced on and projecting from the inner surface for fastening the opposite ends of a belt said body further comprising: a sliding groove formed on the outer surface thereof for mounting a cutting tool, said body having a retaining notch and locating means at one end of the groove to retain said cutting tool in place, and a stub rod for guiding said cutting tool into said sliding groove at the opposite end thereof said cutting tool comprising a blade and a handle, said handle being comprised of a casing covered with a cover plate, said cover plate having an elongated longitudinal slot terminating in an expanded hole, said elongated slot being slightly wider than said stub rod on said body, said casing having an opening at one end for inserting said blade, and a strip spring mounted therein, said strip spring having one end fastened in said casing and a free opposite end, the free end of said strip spring having a raised portion at the top thereof said blade having a hole at one end adapted to receive the raised portion of said strip spring in said casing.

2. The belt buckle of claim 1, wherein when said blade is inserted in said retaining notch and said stub rod is inserted through said expanded hole of said elongated slot into the hole on said blade said handle may be moved into said sliding groove with said blade received in said casing.

3. The belt buckle of claim 1, wherein said locating means includes a plate spring having a free end transversely disposed above said sliding groove, the free end of said plate spring having a raised portion adapted to engage said blade when inserted in said retaining notch against the raised portion on the free end of said strip spring in said casing permitting said blade to be firmly retained in said body.

* * * * *